US005524351A

United States Patent [19]

Pinson et al.

[11] Patent Number: 5,524,351

[45] Date of Patent: Jun. 11, 1996

[54] ARCHERY BOW SIGHT

[75] Inventors: Michael Pinson, Pikeville; James C. Sparks, Prestonsburg; Ronald E. Ward, Paintsville, all of Ky.

[73] Assignee: Accu-Sights Unlimited, Inc., Paintsville, Ky.

[21] Appl. No.: 188,204

[22] Filed: Jan. 27, 1994

[51] Int. Cl.[6] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 3,419,334 | 1/1966 | Hubbard . | |
| 3,487,548 | 1/1970 | Frydenlund | 33/265 |
| 3,488,853 | 3/1970 | Altier | 33/265 |
| 3,766,656 | 10/1973 | Westphal | 33/265 |
| 4,136,461 | 1/1979 | Gasser | 33/265 |
| 4,178,693 | 12/1979 | Smith | 33/265 |
| 4,449,303 | 5/1984 | Larson | 33/265 |
| 4,497,116 | 2/1985 | Hawkins | 33/265 |
| 4,541,179 | 9/1985 | Closson | 33/265 |
| 4,617,741 | 10/1986 | Bordeaux et al. | 33/265 X |
| 4,982,503 | 1/1991 | Land | 33/265 |
| 5,001,837 | 3/1991 | Bray | 33/265 |
| 5,092,053 | 3/1992 | Roberts | 33/265 |
| 5,117,804 | 6/1992 | Jörlöv | 33/265 X |
| 5,152,068 | 10/1992 | Meister et al. | 33/265 |

*Primary Examiner*—Christopher W. Fulton
*Attorney, Agent, or Firm*—Middleton & Reutlinger; David W. Carrithers

[57] ABSTRACT

The present invention relates to archery bows and more particularly to sighting and ranging devices that are attachable to bows carried by archers. The archery bow sight device consists of a housing frame which contains an elevating mechanism serving for supporting the front and rear sighting devices and the windage adjustment mechanisms. This housing frame is free to travel along a curved cam track which is attached directly to the bow. This cam track is adjustable to match the archery bow sight to the draw length of the archer. A leveling indicator is incorporated in the rear sighting device as an indicator to the archer that the bow is not tilted right or left.

19 Claims, 3 Drawing Sheets

ARCHERY BOW SIGHT

BACKGROUND OF THE INVENTION

Since their inception, archery bows have evolved from the simple bow and string arrangement to the current state-of-the-art modern compound bows which, through a series of pulley arrangements, should allow the archer to improve his accuracy because he is not required to maintain maximum pull on the string throughout the full draw.

Archers have long been investigating means of improving their accuracy of aim to take advantage of the modern compound bows and seeking an aiming device readily adjustable at full draw while maintaining proper tilt and eliminating twist. This is not an easily solved problem. Since, unlike firearms, greater corrections for elevation angle and windage must be made. Due to the reduced velocity, configuration, and weight of an arrow it tends to drop appreciably over relative short distances compared to a bullet.

Prior art devices having improved aiming devices range from a very simple single element pin sight mounted on the bow to more elaborate combinations of multi-pin arrangements, cross hairs, peep sights on the bow string, to trigger mechanisms attempting to raise and lower the aiming devices to specific horizontal planes. However, none of the conventional prior art devices allow for a simple wrist and full draw adjustment that will eliminate the problems acquired in bow shooting, such as cant, tilt, twist and yardage adjustment as well as compensating for elevated shooting.

Initially, bows relied on the operators eye and judgement, which came with increasing experience, to aim the bow and determine the proper angle of elevation. Arrow velocities were relatively low and shooting distances were similarly short. Therefore, sophisticated aiming devices were not required. However, with the advent of the compound bow with its inherent ability to produce greater velocities, thus longer shooting distances, the need for improved aiming devices became evident.

Conventional sights range from a very simple single element pin sight mounted on the bow to more elaborate multi-pin arrangements. However, most of these devices require the archer to move his/her eye in relation to the sight, thus modifying their anchor point, which produces a different set of geometric coordinates. Causing the shooter to loose the consistency that insures accuracy.

Conventional sighting devices still leaves the shooter a great deal of self adjustment in regards to target change and, furthermore, he can make no changes especially at full draw. The true problem that exists with conventional sights is that in raising or lowering a bow to meet target changes of either greater or lessor yardage, the bow moves in an arch according to the anchor point of the archer. This movement is part of a segment of a circle. The degree or size of this circle is determined by the draw length of the archer. Thus determining the radius of movement of the bow and so determined by the archer's standard anchor point. Prior art sighting devices are mounted to bows vertically and travel with the bow in perpendicular manner throughout the radius of the arch.

The archer must then change the sighting aperture to a preadjusted aperture to meet the intended target, thus moving the eye or anchor point. Prior art devices do not allow the sighting aperture to readjust for this radius or degree of movement that has been established by the movement of the bow. Therefore, it is theoretically impossible for prior art sights to be absolutely accurate. Conventional sights do not, in their design, compensate for all problems encountered in shooting a bow accurately, such as compensating for radial movement, bow twist, canting, and tilt.

Because of the pull or draw on the bow string to a standard anchor point and the projecting aperture being held in the hand, and the elasticity and moveability of all, the problems of canting, tilt and twisting all become major concerns in accuracy to the intended target. Conventional sight devices do not solve this problem with a single unit.

SUMMARY

The archery bow sight functions as a target aiming device. The operation of this current invention and the mechanism which provides the built-in accuracy and precision of the device is the cam track. In theory, the greater the distance between the archer and the target, the more the archers bow must be tilted upward to compensate for the effects of gravity on the archers arrow once it is released from the bow. Once the arrow is released it moves forward and at the same time is pulled downward due to gravity on the archers arrow. The weight of the arrow and the velocity of the arrow determine the extent of these phenomenon. Various solutions have been proposed to compensate for these characteristics. However, most require that settings be made on a trial and error basis until an acceptable compromise between distance and accuracy is established. Once established, these settings are difficult to change without going through the trial and error method again. What was needed and this present invention provides through the cam track is a method to provide built in accurate and precise settings while allowing the archer to instantaneously change these settings without re-calibrating his bow/sight by trial and error. Moreover, a pendulum sight, more particularly a bubble level indicator, operates in combination with the cam mechanism to correct for tilt further increasing the accuracy of the archer.

The archery bow sight of the present invention is of the type used to propel an arrow and which is actuated by an archer positioned rearward with respect to the bow. The bow has a central region about which the arrow passes and which includes a grip used by the archer as a means for holding the bow. The bow is considered for reference purposes as positioned generally vertically and an arrow on the bow being positioned generally horizontally, wherein the bow and arrow define a vertical reference plane, and the tip of the arrow placed in its conventional position defines a forward direction. It follows the end of the arrow opposite the point defines a rearward direction.

The archery bow sight of the present invention comprises a yardage tracking cam mounting to the bow wherein the tracking cam is positioned in the vertical reference plane at about the central region of the bow for maintaining the same degree of radius as the travel of said bow. The sight includes an adjustable means for mounting the tracking cam to the bow such as set screws which extend from the bow frame through the sides of the tracking cam and are tightened to hold the tracking cam securely at the desired position.

A housing frame is movably mounted in cooperative engagement to the tracking cam by sliding retainer bolts extending from the mounting plate of the housing frame through a transverse slot formed through the side of the tracking cam which is secured by retainer means such as nuts. There is a means for moving the housing frame along the tracking cam incorporating a drive mechanism electrically linked to a silent battery operated DC motor by a wire with the motor being mechanically coupled to a worm gear through at least one reduction gear coupled to a spur gear cooperatively engaging a rack attached to the cam track, and including a means to control the drive mechanism such as push buttons accessible with the fingers when the bow is in the full draw position.

The archery bow sight further includes front and rear sight arm extending from the frame housing. Providing a windage adjustment means comprising front and rear windage adjustment telescoping devices, each including a stationary round forward threaded post oriented in the horizontal plane perpendicular to the front and rear arms extending inwardly toward the bow frame. The forward post is threadably connected to an adjustable round barrel having internal threads formed therein.

Also incorporated within the bow sight is front and rear sighting devices, each one comprising a front pair of cross hairs oriented perpendicularly to one another held stationary within a frame. A bubble level is attached to the rear sighting device to correct for tilt.

It is an object of the present invention to provide a yardage setting indicator that is adjustable at full draw.

It is another object of the present invention to provide a means for vertical alignment of the bow as indicated by a bubble level.

It is another object of the present invention to provide a means for correcting bow twist as so indicated and relieved by the alignment of the front and rear sights.

It is yet another object of the present invention to provide a curved cam track that is adjustable to the specific draw length of individual archer.

It is another object of the present invention to provide both front and rear sighting devices.

It is another object of the present invention to provide the user with a device which is simple to operate and provides the novice archer with a means to quickly and easily improve archery skills without making trial and error adjustments to the sighting device.

It is another object of the present invention to allow the archer to maintain his anchor point and eye position while making adjustments in elevation angle.

It is another object of the present invention to enable the archer to easily and quickly change sighting perimeters while at full draw.

It is another object of the present invention to provide a means which indicates the vertical position of the bow.

It is another object of the invention to allows the archer to make infinite adjustments for windage without resorting to extraneous tools.

It is another object of the present invention to provide a means for the archer to quickly adjust for tilt, cant, and twisting.

It is another object of the present invention to provide a means for the archer to easily and quickly make initial settings on the sighting device, under controlled conditions, based upon the characteristics of the bow and archer, yet allow the archer to similarly alter these settings based on changing circumstances in the field.

It is another object of the present invention to display an initial yardage setting and any subsequent changes in these settings.

It is yet another object of the present invention to allow the novice shooter to simply and quickly improve his skills.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

The archer bow sight of the present invention is manufactured from readily available materials and simple in design. The preferred embodiment is comprised of metal, more particularly steel; however, it is contemplated that plastic or other polymer composite materials could be used in combination with or substituted for the steel components of the present invention.

Figure 1:
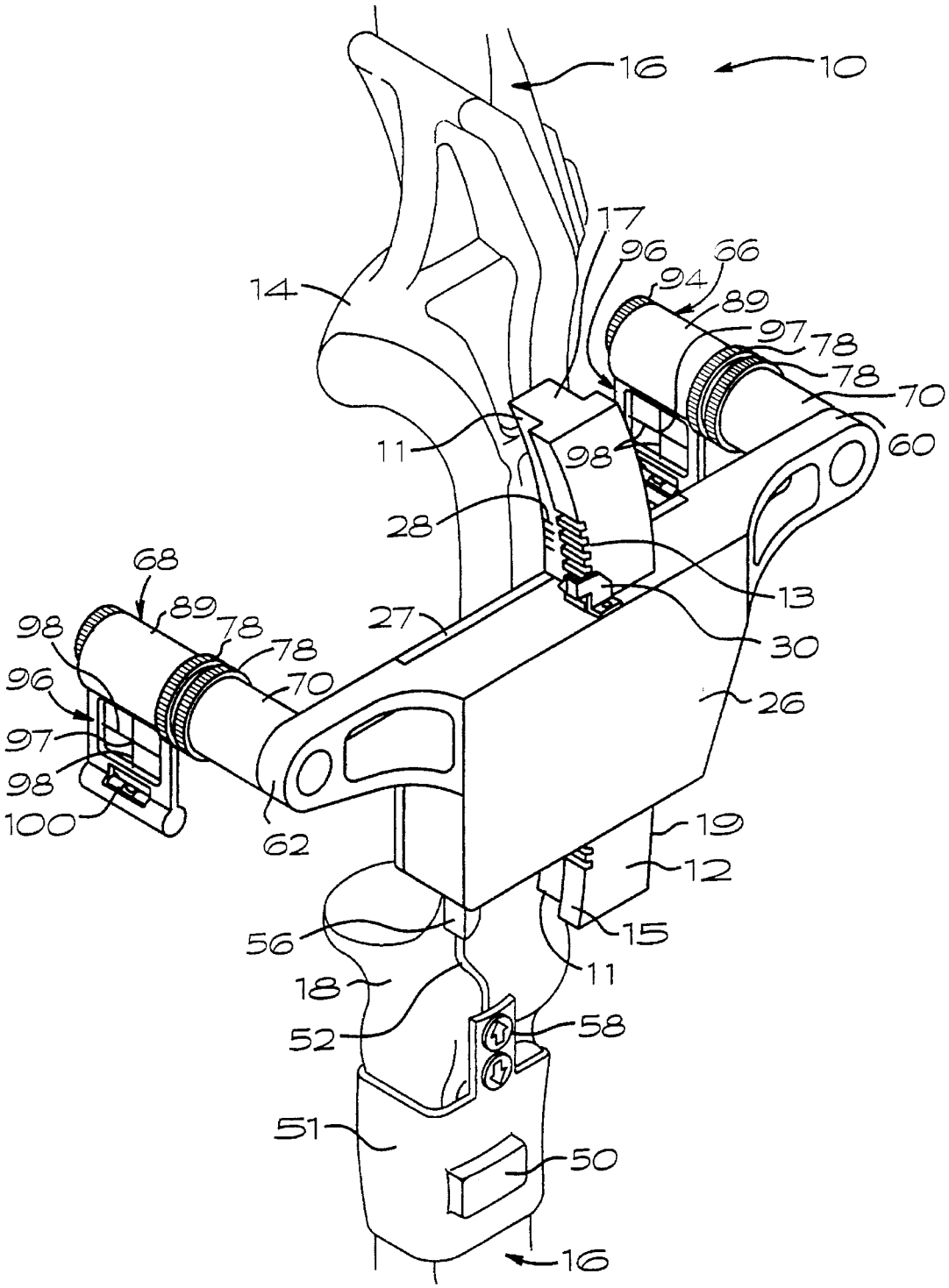
FIG. 1 is a perspective view of the archery bow sight of the present invention showing the cam track and housing frame mounted on the bow.
Figure 2:
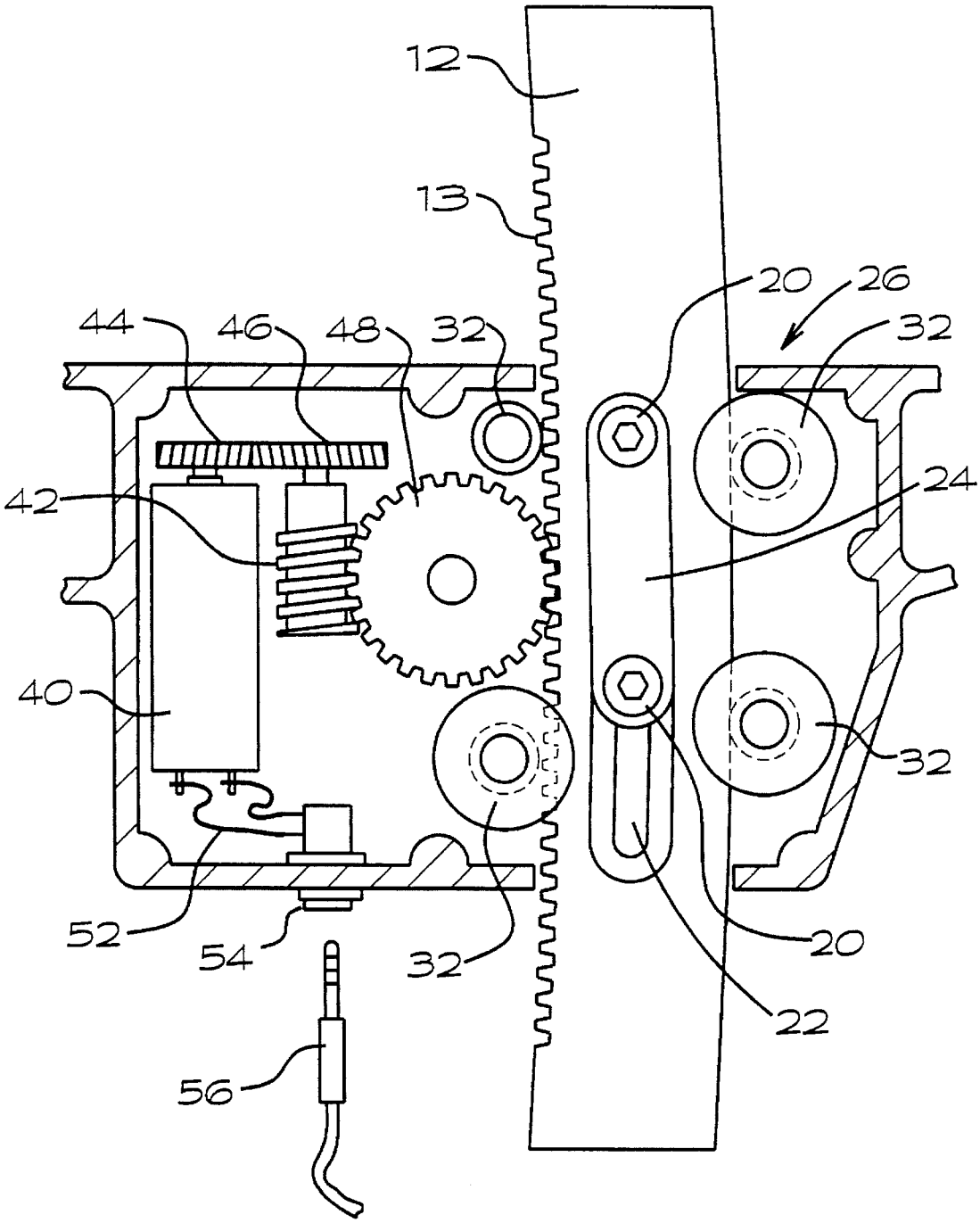
FIG. 2 is cutaway sectional view showing the housing frame attached to the bow and the drive mechanism including for adjusting the sight including the housing frame, gear mechanism, cam track, guide rollers, and the electrical connections to the controls.

Referring now to the drawings, FIG. 1 shows the archer bow sight 10 of the present invention including a yardage tracking cam 12 mounted to the central handle region 14 of the bow frame 16 generally above the grip 18. The cam track 12 is attachable to and detachable from the bow frame 16. As shown the tracking cam 12 is positioned in the vertical reference plane and about the central region 14 of the bow frame 16 for maintaining the same degree of radius as the travel of the bow. The bow sight 10 includes an adjustable means for mounting the tracking cam 12 to the bow frame 16. As is best shown in FIG. 2 a pair of bolts or screws are fastened to the mounting plate 27 of the housing frame 26 and extend outwardly perpendicular therefrom through a transverse radial slot 22 formed within the tracking cam 12. The mounting plate 27 of the sight housing frame 26 is secured to the tracking cam 12 by a friction fit wherein the distal ends of the screws 20 extend through a pressure plate 24 and are secured by nuts which are tightened to hold the mounting plate 27 of the housing frame 26 slideably to the tracking cam 12 at the selected position. For adjustment purposes, the bolts 20 are slidable held within the tracking cam 12 so that the housing frame 26 can be adjusted with respect to the tracking cam 12. In the preferred embodiment, the cam track 12 is attachable to and detachable from an archery bow through a standard screw mounting (#10–24 screws on 1.31 inch center to center spacing).

Figure 3:
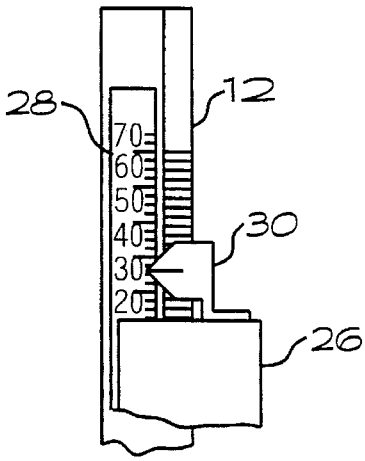
FIG. 3 is a front view showing the distance indicator and its pointer and their relationship to the cam track and housing frame of the present invention.

As best shown in FIG. 1, the cam track 12 is formed having a generally "T" shaped curve formed as a segment of an ellipse or circle forming radius which corresponds to the draw length of the archers bow, generally 28 to 31 inches, (71–78 cm). The tracking cam 12 includes a traction strip along the rear portion of the tracking cam 12 in cooperative engagement with a means for moving the housing frame 26 along the tracking cam 12. The rear outer curved surface 11 of the cam track 12 includes a plurality of depressions or grooves therein forming a rack 13 for engagement by a drive means within the housing frame 26. The rear inner curved surface 15 of the cam track 12 adjacent the bow handle 14 and having a lesser diameter than the rear outer curved surface 11 is smooth providing a guiding and/or friction surface for an alignment means. The front and rear inner curve surfaces 17 and 11, respectively of the cam track 12 is of a lesser diameter than the front outer surface 19 of the cam track 12 and also provides a guiding and friction surface for an aligning means. Furthermore, the cam rack 13 provides a traction mechanism whereby a sight housing frame 26 is movably supported by the cam track 12 to travel upward and downward along the cam track 12. Moreover, as shown best in FIG. 3, a distance scale 28 having indicia is printed or adhered to the rear curved portion of the cam track 12. A pointer 30 mounted upon the top surface of the housing frame 26 indicates the distance for which the device is presently set relative to a selected set point. The sight housing frame 26 is adjustable, in relation to the cam track 12, over a limited range, to allow the archer to make minor adjustments based on personal preferences.

The housing frame 26 which encloses the drive mechanism provides a base for attachment to the cam track 12 and a support means for the various other components of the sight 10. The housing frame 26 is movably mounted in cooperative engagement to the tracking cam 12. The housing frame 26 has a plurality of rollers 32 rotating on pins between the sides of the housing frame 12. The rollers 32 are spaced apart from one another and positioned within the housing frame 26 to provide pressure upon the rear inner curved surface 15 and front inner curved surface 17 to provide pressure, support, and alignment of the housing frame 26 with respect to the cam track 12 and allow for upward and downward movement of the housing frame 26 relative to the cam track 12 as best shown in FIG. 2.

The drive mechanism is shown best in FIGS. 1 and 2. The drive mechanism of the preferred embodiment consists of a permanent magnet DC motor 40 which is coupled to a worm gear 42 through a gear reduction cluster 44, 46. The worm gear 42 is coupled to a spur gear 48 which has a plurality of teeth in cooperative engagement with the rack 13 of the cam track 12.

In the preferred embodiment, an external power source consisting of a 9 volt battery pack 50 is contained by a holding means such as a strip of velcro wrapped around the grip of the riser of the bow frame 16. The battery pack 50 is connected to the motor 40 through wires 52 extending from the motor to an external jack 54 connected to the battery pack 50 by a cable connection 56. Control means for activating the motor 40 causing upward and downward movement of the housing frame 26 along the cam track 12 consists of upward and downward control buttons 58 electrically linked to the battery pack 50 and motor 40. The control buttons 58 are positioned in such a manner that the controls are placed within reach of the archers finger while he is at full draw. The control buttons 58 allow the motor armature to rotate clockwise or counterclockwise thus moving the housing frame 26 up or down the cam track 12 to adjust the bow sight 10 to a given indicated distance.

In the preferred embodiment, the housing frame 26 of the bow sight 10 includes a front arm 60 and a rear arm 62 extending therefrom as an integral part of the housing frame 26. The front arm 60 and rear arm 62 form part of a windage adjustment mechanism 64 as best shown in FIG. 2. The windage adjustment mechanism 64 consists of a front windage adjustment 66 and a rear windage adjustment 68 which are identical in design and construction.

Figure 4:
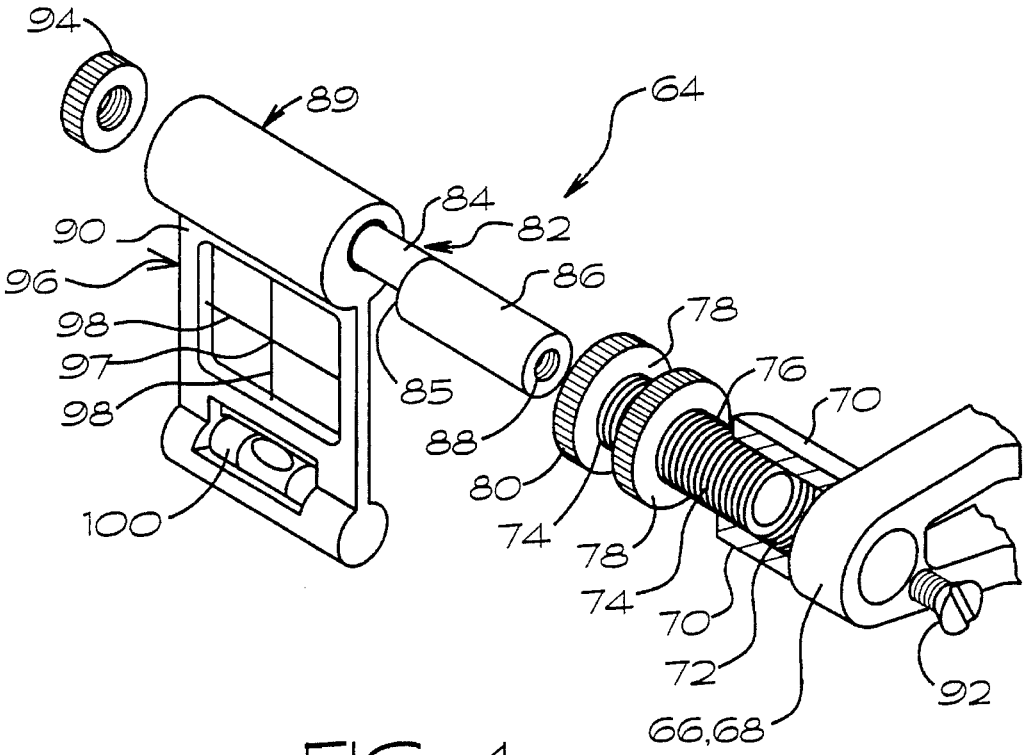
FIG. 4 is an exploded isometric view showing the windage adjustment mechanism of the present invention.

As shown in FIG. 4, each windage adjustment 66, 68 includes a stationary round sleeve 70 formed integrally with each arm 66, 68 and extending perpendicular therefrom, inwardly toward the bow frame 16. Each sleeve 70 has internal threads 72 therein. A hollow barrel 74 having an smooth interior surface and external threads 76 therearound is threadably connected within each of said sleeves 70. Adjustment wheels 78 having a greater diameter than the barrels 70 are attached to, or as with the preferred embodiment, formed as an integral part of the barrel 74. As shown in FIG. 4, the adjustment wheels 78 have a greater diameter than the barrel 74 and the outer surface of the adjustment wheels is provided with a knurled surface 80 for easy gripping.

The windage adjustment mechanisms 64 further consist of a rod 82 having a cylinder portion 84 and a cammed portion 86 each having a smooth exterior surface. The cam 86 is used for tilting the sights 89 forward or rearward and therefor has a larger external diameter than the cylinder 84 forming a step 85 therebetween. An internal threaded axial bore 88 is formed in the distal end of the cam 86. The cylindrical portion 84 of the rod 82 is inserted through a complimentary sized bore within the sight 89 so that the step 85 abuts the sighting frame 89 and the distal end of the cylindrical rod portion 84 is removably secured by retainer nut 94 within the sight 89, whereby loosening of the retainer nut 94 permits rotational adjustable of the sight 89 to a selected position. Thus turning the retaining nut 94 permits rotation of rod 84 to move the sight frame 90 up or down. The distal end of the rod 82 forming the cam portion 86 is slidably inserted into barrel 74 which is rotatably secured in cooperative engagement with a retaining means such as screw 92 so that the distal end of the barrel 74 abuts the sight 89 forming a compression fit therewith. The end of the cam portion 86 fits within the barrel 74 and is rotatably secured with a screw 92 extending through the end of the arm 66, 68. The rod 82 only rotates when the screw 92 is loosened to set the concentric cam 86 for eye level sighting. Moreover, a knurled lock nut or tap 78 having internal threads is threadably connected to the exterior threads 76 of the barrel 74. The rod assembly 82 provides a support for the sighting device 89 and also allows the sighting device 89 to rotate relative to the housing frame 26.

The windage adjustment permitting right or left positioning of the sights 89 with respect to the bow 16. Windage adjustment is accomplished by turning wheel knob 78 rotating barrel 74 within sleeve 70 thereby moving sight 89 to the left or right in a telescoping manner.

Incorporated within the sight 89 is a sighting frame 90 forming a cross hair aperture 97 having dual cross hairs 96. The perpendicular cross hairs are positioned horizontally and vertically in such a manner that they cross each other at their mid points. The cross hairs 96 may be printed or embedded within a clear plastic mounted within the frame 90. The cam 86 of the windage adjustment devices 64 provides a support for the sighting device 89 and also allows the sighting device 89 to rotate relative to the housing frame 26. Thus the sighting device 89 maintains its vertical orientation regardless of the up or down tilt of the bow frame 16. The sighting devices 89 are mounted eccentricity on the rod 82 to allow minor adjustments in the sighting device 89 to compensate for subtle differences in the physical features of the archer (i.e. distance from anchor point-usually corner of the mouth-to the archer's eye. The adjustment is made by rotating the rod 82 in relationship to the sighting device 89, then securing the sighting device 89 to the rod 82 by tightening a nut 94.

Furthermore, the rear sighting device 89 contains a bubble level 100 within the sight window frame 90 which indicates when the bow frame 16 is being held level with respect to the vertical plane for quick adjustment of bow tilt. By changing the front windage adjustment mechanism 66 in relation to the rear windage adjustment mechanism 68 the archer can establish a desirable relationship with the aide of a silent DC motor 40 that is activated by an up button and down buttons 58. The housing frame 26 will move along the tracking cam 12 in the same degree or radius as the bow 16, thus allowing for yardage changes to be made at full draw of the bow 16 which is not possible with conventional bow sights. The procedure simply requires rotating the barrels 74 in relation to the sleeves 70. Once the adjustment is made, the lock nut 94 is rotated on the barrel 74 until it comes into contact with the barrel 74, locking the barrel 74 relative to the sleeve 70.

By aligning both front and rear cross hairs 96 in correspondence with each other, twisting and canting are relieved. Both front and rear cross hair apertures 97 are adjustable for windage, and personal characteristics of sight alignment. The archer needs only to deal with the alignment of the dual cross hairs 96 and a quick look at a yardage indicator well laid within the sight plane.

The tracking cam 12 provides a means for achieving greater accuracy as is determined by the draw length of the archer. As the bow 16 is raised or lowered to meet target needs, the housing frame 26 containing the cross hair apertures 97 is moved along the tracking cam in the same degree or radius as the bow 16, thus allowing for yardage changes to be made at full draw of the bow which is not possible with conventional sights. The archer then using the same cross hairs 96 and not having to change anchor points or eye level to align the two cross hairs, can achieve theoretical absolute accuracy. The uniqueness of design of this invention meets the problems of absolute accuracy so desired in archers for hunting and in the world of tournament shooting and also allows for a long awaited solution of being able to make quick yardage changes at full draw, while also allowing for increment ranges.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. An archery bow sight of the type used to propel an arrow and which is actuated by an archer positioned rearward with respect to a bow frame, said bow frame having a central region about which the arrow passes and which includes a grip used by the archer as a means for holding said bow frame, said bow frame being considered for reference purposes as positioned generally vertically and an arrow on said bow frame being positioned generally horizontally, said bow frame and arrow defining a vertical reference plane, and the tip of the arrow placed in its conventional position defining a forward direction and the end of the arrow opposite the point defining a rearward direction, said bow sight comprising:

a yardage tracking cam mounted to said bow frame, said tracking cam being positioned generally in the vertical reference plane and about the central region of said bow frame for maintaining a corresponding degree of radius as the draw length of said bow frame;

means for mounting said tracking cam to said bow;

a frame housing movably mounted in cooperative engagement to said tracking cam;

means for moving said frame housing along said tracking cam;

a front windage adjustment means comprising a front windage adjustment device mounted to a front arm extending from said frame housing, said windage adjustment device comprising a sleeve having threads, said sleeve extending inwardly perpendicular from said arm toward said bow frame, a barrel having threads threadably and rotatably engaging said sleeve, a rod having a concentric cam portion rotatably retained within said barrel, said rod including a cylindrical portion in rotatable engagement with a first sighting device;

a rear windage adjustment means comprising a rear windage adjustment device mounted to a rear arm extending from said frame housing, said windage adjustment device comprising a sleeve having threads, said sleeve extending inwardly perpendicular from said arm toward said bow frame, a barrel having threads threadably and rotatably engaging said sleeve for telescoping movement of said barrel into or out of said sleeve for moving a second sighting device to the right or to the left, a rod having a concentric cam portion rotatably retained within said barrel, said rod including a cylindrical portion in rotatable engagement with said second sighting device for tilting said second sighting device forward or rearward; and said first and second sighting device(s) being adjustably mounted to said front windage adjustment means, and said rear windage adjustment means selectively, said first and second sighting device(s) comprising a pair of cross hairs oriented perpendicularly to one another held stationary within a sight frame.

2. The archery bow sight of claim 1, said tracking cam including a traction strip along the rear portion of said tracking cam in cooperative engagement with said means for moving said frame housing along said tracking cam.

3. The archery bow sight of claim 2, wherein said traction strip is a rack.

4. The archery bow sight of claim 1, wherein said means for moving said frame housing along said tracking cam comprises a drive mechanism electrically linked to a battery operated motor by a wire, said motor being mechanically coupled to a worm gear through at least one reduction gear coupled to a spur gear cooperatively engaging a rack attached to said tracking cam, and including a means to control said drive mechanism.

5. The archery bow sight of claim 1, wherein said means for moving said frame housing along said tracking cam is mounted to said bow frame using a Velcro strap that wraps around the grip of said bow frame.

6. The archery bow sight of claim 4, wherein said means for moving said frame housing along said tracking cam includes an up button and a down button within reach of the archer's finger while the bow frame is at full draw.

7. The archery bow sight of claim 1, wherein said means for mounting said tracking cam to said bow frame is at least one screw.

8. The archery bow sight of claim 1, wherein said means for mounting said tracking cam to said bow frame is adjustable.

9. The archery bow sight of claim 1, wherein said means for moving said frame housing along said tracking cam comprises a pair of screws attached to and extending perpendicularly outward from said frame housing through a radial slot formed through the sides of said tracking cam and secured to said tracking cam with a pressure plate held thereto by nuts, wherein the screws adjustably tighten the plate and housing frame around said tracking cam allowing said housing frame to be adjustably moved upward and downward along the slot formed in said tracking cam.

10. The archery bow sight of claim 1, wherein a portion of the exterior surface of said front windage adjustment barrel and said rear windage adjustment barrel threadably engages a knurled tap for improved grip.

11. The archery bow sight of claim 1, including a bubble level attached to said rear sighting device for correcting tilt.

12. An archery bow sight of the type used to propel an arrow and which is actuated by an archer positioned rearward with respect to a bow frame, said bow frame having a central region about which the arrow passes and which includes a grip used by the archer as a means for holding said bow frame, said bow frame being considered for reference purposes as positioned generally vertically and an arrow on said bow frame being positioned generally horizontally, said bow frame and arrow defining a vertical reference plane, and the tip of the arrow placed in its conventional position defining a forward direction and the end of the arrow opposite the point defining a rearward direction, said bow sight comprising:

a yardage tracking cam mounting to said bow, said tracking cam being positioned generally in the vertical reference plane and about the central region of said bow for maintaining the same degree of radius as the travel of said bow;

means for mounting said tracking cam to said bow;

a frame housing movably mounted in cooperative engagement to said tracking cam;

means for moving said frame housing along said tracking cam; and a front windage adjustment means incorporating a cam mechanism in rotatable engagement with a front sighting device adjustably mounted thereto, a rear windage adjustment means incorporating a cam mechanism in rotatable engagement with a rear sighting device adjustably mounted thereto.

13. The archery bow sight of claim 12, said front and rear sighting device comprising a pair of cross hairs oriented perpendicularly to one another held stationary within a frame.

14. The archery bow sight of claim 12, wherein said front sighting device aligns with said rear sighting device.

15. The archery bow sight of claim 12, including means for holding said housing frame in position in cooperative engagement with said tracking cam.

16. The archery bow sight of claim 12, wherein said means for moving said frame housing along said tracking cam comprises a rack.

17. The archery bow sight of claim 16, said tracking cam including a guide means for exerting pressure and for adjustably holding said housing frame to said tracking cam.

18. The archery bow sight of claim 12, said front windage adjustment means and said rear windage adjustment means comprising:

a windage adjustment device mounted to an arm extending from said frame housing, said windage adjustment device comprising a sleeve having threads, said sleeve extending inwardly perpendicular from said arm toward said bow frame, a barrel having threads threadably and rotatably engaging said sleeve, a rod having a concentric cam portion rotatably retained within said barrel, said rod including a cylindrical portion in rotatable engagement with a sighting device.

19. A windage adjustment means for a bow frame comprising:

an arm extending forward or rearward from said bow frame housing having a stationary sleeve having internal threads therein said stationary sleeve extending inwardly normal to said arm toward said bow frame, a hollow barrel having external threads therearound threadably engaging said internal threads of said sleeve, a rod having a cylindrical portion and a cammed portion each having a smooth exterior surface, said cammed portion having a larger external diameter than said cylindrical portion forming a step thereinbetween, said cammed portion having internal threads extending therethrough, wherein said cylindrical portion of said rod is rotatably retained within a sighting device having a complementary sized bore extending therethrough, said step of said rod abutting said sighting device and said cylindrical portion being rotatably secured with a retainer means, and said cammed portion slidably engaging said barrel in cooperative engagement with a retaining means extending through said arm.

* * * * *